US011596980B2

(12) United States Patent
Kho et al.

(10) Patent No.: US 11,596,980 B2
(45) Date of Patent: Mar. 7, 2023

(54) VIBRATION GENERATING DEVICE AND ELECTRONIC APPARATUS INCLUDING THE SAME

(71) Applicant: LG Display Co., Ltd., Seoul (KR)

(72) Inventors: YuSeon Kho, Paju-si (KR); Chiwan Kim, Paju-si (KR); Taeheon Kim, Paju-si (KR); Sung-Eui Shin, Paju-si (KR); YongWoo Lee, Paju-si (KR); Kyungyeol Ryu, Paju-si (KR); YongGyoon Jang, Paju-si (KR)

(73) Assignee: LG Display Co,. Ltd., Seoul (KR)

( * ) Notice: Subject to any disclaimer, the term of this patent is extended or adjusted under 35 U.S.C. 154(b) by 678 days.

(21) Appl. No.: 16/655,928

(22) Filed: Oct. 17, 2019

(65) Prior Publication Data

US 2020/0171542 A1 Jun. 4, 2020

(30) Foreign Application Priority Data

Nov. 29, 2018 (KR) ..... 10-2018-0151305

(51) Int. Cl.
*B06B 1/06* (2006.01)
*B06B 1/04* (2006.01)

(52) U.S. Cl.
CPC ..... *B06B 1/0629* (2013.01); *B06B 1/045* (2013.01)

(58) Field of Classification Search
CPC ..... B06B 1/0629; B06B 1/045; B06B 1/0622; H04R 17/005; H04R 17/00; H04R 7/045; H04R 2499/11; H04R 2499/15; H01L 41/047; H01L 41/09; H01L 41/193; H01L 41/25
See application file for complete search history.

(56) References Cited

U.S. PATENT DOCUMENTS 2,266,333 A * 12/1941 Ream ..... H03H 3/02 29/25.35
5,239,736 A * 8/1993 Sliwa, Jr ..... B06B 1/06 29/418
6,984,284 B2 * 1/2006 Yin ..... B06B 1/0622 156/263
6,984,922 B1 1/2006 Nagahara et al.
6,986,189 B2 * 1/2006 Kitahara ..... H01L 41/273 29/25.35
9,621,997 B2 4/2017 Miyoshi et al.
9,761,784 B2 9/2017 Miyoshi
10,877,585 B2 * 12/2020 Noh ..... G06F 3/162
(Continued)

FOREIGN PATENT DOCUMENTS

CN 1478439 A 3/2004
CN 1788366 A 6/2006
(Continued)

OTHER PUBLICATIONS

Office Action issued in corresponding CN Patent Application No. 201911021425.X dated Dec. 18, 2020.

*Primary Examiner* — Oyesola C Ojo
(74) *Attorney, Agent, or Firm* — Morgan, Lewis & Bockius LLP

(57) ABSTRACT

A vibration generating device includes a first piezoelectric device including at least one slit, a first electrode on a first surface of the first piezoelectric device, and a second electrode on a second surface opposite to the first surface of the first piezoelectric device.

24 Claims, 7 Drawing Sheets

(56) References Cited

U.S. PATENT DOCUMENTS

| | | | | |
|---|---|---|---|---|
| 2002/0186856 | A1* | 12/2002 | Kihara | H04R 1/345 381/190 |
| 2003/0007651 | A1* | 1/2003 | Nakashima | H04R 17/00 381/114 |
| 2015/0003642 | A1* | 1/2015 | Nakamura | H04R 1/288 381/162 |
| 2018/0041839 | A1 | 2/2018 | Abe et al. | |
| 2018/0069168 | A1* | 3/2018 | Ikeuchi | H01L 41/314 |
| 2019/0014420 | A1 | 1/2019 | Kim et al. | |
| 2019/0064991 | A1* | 2/2019 | Noh | G06F 3/162 |
| 2019/0141456 | A1* | 5/2019 | Dogiamis | B06B 1/0625 |
| 2019/0324569 | A1* | 10/2019 | Ma | H01L 41/1132 |

FOREIGN PATENT DOCUMENTS

| | | | |
|---|---|---|---|
| CN | 104012115 | A | 8/2014 |
| CN | 107431863 | A | 12/2017 |
| CN | 109218931 | A | 1/2019 |
| JP | 2-51289 | A | 2/1990 |
| JP | 11-285096 | A | 10/1999 |
| KR | 10-2014068121 | A | 6/2014 |
| KR | 10-20150124986 | A | 11/2015 |
| KR | 10-1628584 | B1 | 6/2016 |
| KR | 10-1777491 | B1 | 9/2017 |
| WO | 2018/020887 | A1 | 2/2018 |

* cited by examiner

VIBRATION GENERATING DEVICE AND ELECTRONIC APPARATUS INCLUDING THE SAME

CROSS-REFERENCE TO RELATED APPLICATIONS

This application claims the benefit of and priority to Korean Patent Application No. 10-2018-0151305, filed on Nov. 29, 2019, the entirety of which is hereby incorporated by reference.

BACKGROUND

Technical Field

The present disclosure relates to a vibration generating device and an electronic apparatus including the same.

Discussion of the Related Art

Generally, electronic apparatuses such as televisions (TVs), monitors, notebook computers, smartphones, tablet computers, electronic pads, wearable apparatuses, watch phones, portable information devices, navigation apparatuses, and automotive control display apparatuses include a display apparatus for displaying an image and a sound device for outputting a sound associated with the image. Also, a fingerprint identification function using a capacitive or optical fingerprint sensor is being recently applied to electronic apparatus, for reinforcing security and convenience of use.

In general electronic apparatuses, since a sound output from a sound device travels in a direction toward a rear surface or a lower surface (or a side surface) of a display apparatus, sound quality is degraded due to interference between sounds reflected from a wall and the ground, and for this reason, it is difficult to transfer an accurate sound and an immersion experience of a viewer is reduced.

Moreover, since each electronic apparatus includes an actuator, each electronic apparatus may output a sound to a forward region in front of a display panel, but the actuator may have a strong vibration characteristic in only a specific frequency domain and may decrease in vibration characteristic in the other frequency domain. That is, the actuator has a problem where the actuator cannot cover a whole audible frequency domain. Also, there is a problem where the related art actuator is difficult to have a strong output characteristic in a high frequency domain.

SUMMARY

Accordingly, embodiments of the present disclosure are directed to provide a vibration generating device and an electronic apparatus including the same that substantially obviate one or more the issues due to limitations and disadvantages of the related art.

An aspect of the present disclosure is to provide a vibration generating device which includes a first piezoelectric device including at least one slit and a second piezoelectric device including an accommodation part accommodated into the at least one slit, thereby enhancing an output characteristic in a high frequency domain.

Another aspect of the present disclosure is to provide a vibration generating device which includes a first piezoelectric device including a plurality of protrusion portions and a second piezoelectric device including an accommodation part overlapping each of the plurality of protrusion portions in a thickness direction of the first piezoelectric device, thereby enhancing a sound pressure level in an audible frequency domain.

Another aspect of the present disclosure is to provide an electronic apparatus which includes a vibration generating panel including first and second vibration generating devices including a different number of slits, thereby integrating a receiver and a speaker.

Another aspect of the present disclosure is to provide an electronic apparatus which includes a vibration generating panel including first and second vibration generating devices including first and second piezoelectric devices and a third vibration generating device including a third piezoelectric device, thereby integrating a receiver, a speaker, and a haptic layer.

Additional advantages and features of the disclosure will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and claims hereof as well as the appended drawings.

To achieve these and other aspects of the inventive concepts as embodied and broadly described herein, a vibration generating device comprises a first piezoelectric device including at least one slit, a first electrode on a first surface of the first piezoelectric device, and a second electrode on a second surface opposite to the first surface of the first piezoelectric device.

In another aspect, an electronic apparatus comprises a display module configured to display an image and a vibration generating panel including at least one vibration generating device on one surface of the display module, wherein the vibration generating device includes a first piezoelectric device including at least one slit, a first electrode on s first surface of the first piezoelectric device, a second piezoelectric device including an accommodation part accommodated into the at least one slit and covering a second surface opposite to the first surface of the first piezoelectric device, and a second electrode on a second surface opposite to a first surface of the second piezoelectric device facing the first piezoelectric device.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this application, illustrate embodiments of the disclosure and together with the description serve to explain various principles of the disclosure.

DETAILED DESCRIPTION

Figure 1:
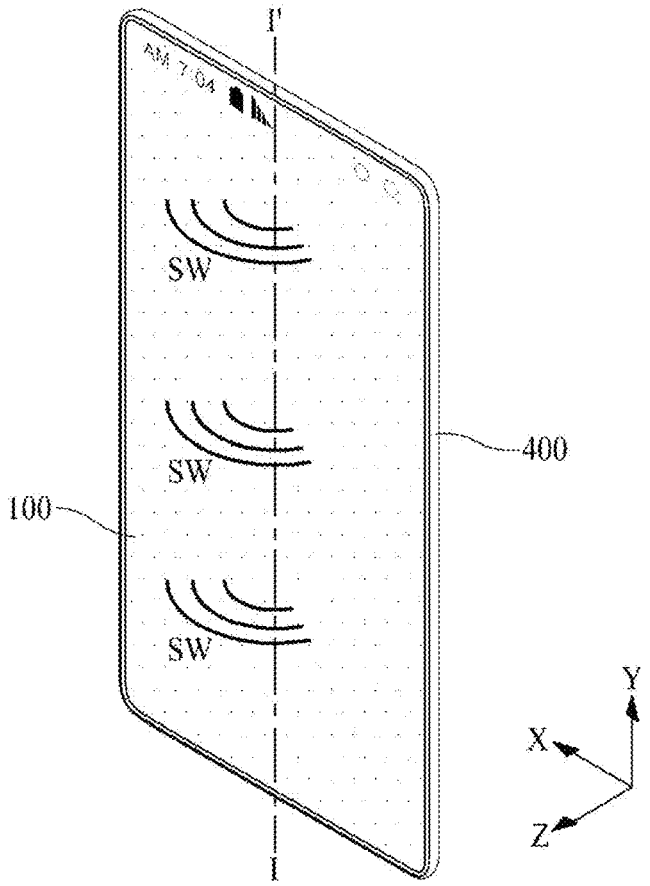
FIG. 1 is a perspective view illustrating an electronic apparatus according to an embodiment of the present disclosure.

Reference will now be made in detail to embodiments of the present disclosure, examples of which may be illustrated in the accompanying drawings.

Throughout the drawings and the detailed description, unless otherwise described, the same drawing reference numerals should be understood to refer to the same elements, features, and structures. The relative size and depiction of these elements may be exaggerated for clarity, illustration, and convenience.

In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Furthermore, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. In the following description, when the detailed description of the relevant known technology is determined to unnecessarily obscure the important point of the present disclosure, the detailed description will be omitted.

When "comprise," "have," and "include" described in the present specification are used, another part may be added unless "only" is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," and "next" one or more other parts may be disposed between the two parts unless "just" or "direct(ly)" is used.

In describing a time relationship, for example, when the temporal order is described as "after," "subsequent," "next," and "before," a case which is not continuous may be included unless "just," "immediate(ly)," or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

In the present disclosure, a display apparatus may include a display apparatus such as a liquid crystal module (LCM) or an organic light emitting display (OLED) module including a display panel and a driver for driving the display panel. The display apparatus may include a set electronic device or a set device (or a set apparatus) such as a notebook computer, a TV, a computer monitor, an equipment apparatus including an automotive apparatus or another type apparatuses for vehicles, or a mobile electronic apparatus such as a smartphone or an electronic pad, which is a complete product (or a final product) including an LCM or an OLED module.

In some embodiments, an LCM or an OLED module including a display panel and a driver may be referred to as a display apparatus, and an electronic apparatus which is a final product including an LCM or an OLED module may be referred to as a set apparatus. For example, the display apparatus may include a display panel, such as an LCD or an OLED, and a source printed circuit board (PCB) which is a controller for driving the display panel. The set apparatus may further include a set PCB which is a set controller electrically connected to the source PCB to overall control the set apparatus.

A display panel applied to an embodiment of the present disclosure may use any type of display panel, such as a liquid crystal display panel, an organic light emitting diode (OLED) display panel, and an electroluminescent display panel, but is not limited to a specific display panel, which is vibrated by a sound generation device according to an embodiment of the present disclosure to output sound. Also, a shape or a size of a display panel applied to a display apparatus according to an embodiment of the present disclosure is not limited.

For example, if the display panel is the liquid crystal display panel, the display panel may include a plurality of gate lines, a plurality of data lines, and a plurality of pixels respectively provided in a plurality of pixel areas defined by intersections of the gate lines and the data lines. Also, the display panel may include an array substrate including a thin film transistor (TFT) which is a switching element for adjusting a light transmittance of each of the plurality of pixels, an upper substrate including a color filter and/or a black matrix, and a liquid crystal layer between the array substrate and the upper substrate.

Moreover, if the display panel is the organic light emitting display panel, the display panel may include a plurality of gate lines, a plurality of data lines, and a plurality of pixels respectively in a plurality of pixel areas defined by intersections of the gate lines and the data lines. Also, the display panel may include an array substrate including a TFT which is an element for selectively applying a voltage to each of the pixels, an organic light emitting device layer on the array substrate, and an encapsulation substrate on the array substrate to cover the organic light emitting device layer. The encapsulation substrate may protect the TFT and the organic light emitting device layer from an external impact and may prevent water or oxygen from penetrating into the organic light emitting device layer. Also, a layer provided on the array substrate may include an inorganic light emitting layer (for example, a nano-sized material layer, a quantum dot, or the like). As another example, the layer on the array substrate may include a micro light emitting diode.

Hereinafter, embodiments of the present disclosure will be described in detail with reference to the accompanying drawings.

Figure 2:
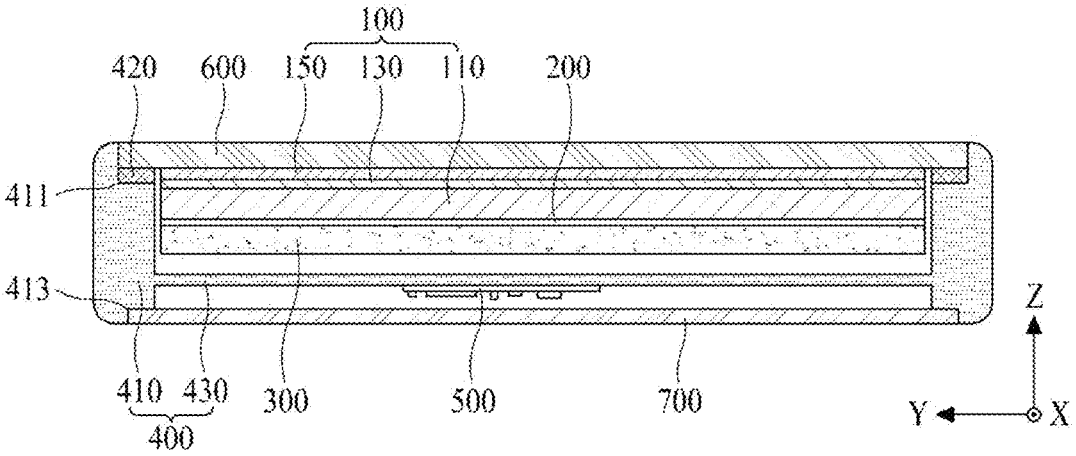
FIG. 2 is a cross-sectional view taken along line I-I' of FIG. 1.

FIG. 1 is a perspective view illustrating an electronic apparatus according to an embodiment of the present disclosure. FIG. 2 is a cross-sectional view taken along line I-I' of FIG. 1.

With reference to FIGS. 1 and 2, the electronic apparatus according to an embodiment of the present disclosure may include a display module 100, a vibration generating panel 300, a housing 400, a driving circuit unit 500, a cover window 600, and a rear cover 700.

The display module 100 may include a display panel 110, a polarizing film 130, and a touch panel 150.

The display panel 110 may be configured to display an image, and may be implemented as any type of display panel, such as a liquid crystal display panel, an organic light emitting diode (OLED) display panel, and an electroluminescent display panel, etc.

The display panel 110 may include a pixel array that may display an image based on image data. In the pixel array, a plurality of data lines may intersect a plurality of gate lines, and a plurality of pixels may be arranged as a matrix type. Each of the plurality of pixels may include a red subpixel, green subpixel, and a blue subpixel, for implementing colors. Also, each of the plurality of pixels may further include a white subpixel.

The polarizing film 130 may be between the display panel 110 and the cover window 600. According to an embodiment of the present disclosure, the polarizing film 130 may be attached (or coupled) on the display panel 110 by a film attachment member. The polarizing film 130 may circularly polarize external light reflected by the TFT and/or the pixel driving lines provided on the pixel array substrate, thereby enhancing the visibility and contrast ratio of the display panel 110. The polarizing film 130 may be between the touch panel 150 and the cover window 600.

The touch panel 150 may be between the display panel 110 and the cover window 600. According to an embodiment of the present disclosure, the touch panel 150 may include a touch electrode layer which is provided on the polarizing film 130, and may include a touch electrode for sensing (or detecting) a user touch applied to the display module 100. The touch electrode layer may sense a capacitance variation of the touch electrode caused by the user touch. For example, the touch electrode layer may include the touch electrode for sensing the user touch based on a mutual capacitive type or a self-capacitive type.

The vibration generating panel 300 may be coupled or connected to one surface of the display module 100, for example, a rear surface of the display panel 110. The vibration generating panel 300 may be a piezoelectric panel. According to an embodiment of the present disclosure, the vibration generating panel 300 may be attached to the rear surface of the display panel 110 by an adhesive member 200 so as to directly vibrate the display module 100. For example, the vibration generating panel 300 may be attached to the whole rear surface of the display panel 110. The vibration generating panel 300 may vibrate the display module 100 based on the a vibration signal supplied from the driving circuit unit 500, and thus, may output a sound SW to a forward region Z in front of the display module 100 based on the vibration of the display module 100. For example, the vibration generating panel 300 may vibrate the display module 100 based on an inverse piezoelectric effect based on the vibration signal.

The adhesive member 200 may include a natural curable adhesive, a thermocurable adhesive, or a photocurable adhesive. For example, the adhesive member 200 may be formed of the natural curable adhesive for reducing or preventing a characteristic of the vibration generating panel 300 from being degraded by heat occurring in a curing process.

The housing 400 may accommodate the display module 100 to surround a rear surface and a side surface of the display module 100. For example, each of side surfaces of the housing 400 may be rounded to have a certain curvature radius, for enhancing an aesthetic design of the electronic apparatus. The housing 400 may be referred to as a "middle frame," a "module frame," a "display housing," or a "panel guide." According to an embodiment of the present disclosure, the housing 400 may include a housing sidewall 410, a buffering member 420, and a housing plate 430.

The housing sidewall 410 may have a frame shape to have a display accommodating space into that the display module 100 is accommodated, and may surround each of the side surfaces of the display module 100. The housing sidewall 410 may support the cover window 600 and the rear cover 700. The housing sidewall 410 may include an upper stepped portion 411, which is concavely provided from an upper inner surface to support the cover window 600, and a lower stepped portion 413 which is concavely provided from a lower inner surface to support the rear cover 700.

The buffering member 420 may be between the cover window 600 and the upper stepped portion 411 of the housing 400. The buffering member 420 may include a double-sided tape or a foam pad, but is not limited thereto. The buffering member 420 may reduce an impact applied to the cover window 600 and may reduce or prevent a vibration of the display module 100 from being transferred to the housing 400.

The housing plate 430 may be connected to an inner surface of the housing sidewall 410 to cover the rear surface of the display module 100. Therefore, the display accommodating space may be provided in a front surface of the housing plate 430, and may be surrounded by the housing sidewall 410, and a circuit accommodating space may be provided in a rear surface of the housing plate 430 and may accommodate circuits such as the driving circuit unit 500 and peripheral circuits of the electronic apparatus including a battery. Therefore, the housing plate 430 may be spaced apart from the rear surface of the display module 100, and moreover, may be spaced apart from the rear cover 700.

The driving circuit unit 500 may be at one surface of the housing plate 430. For example, the driving circuit unit 500 may generate an image signal and may supply the image signal to each of the plurality of pixels to allow the display panel 110 to display an image. The driving circuit unit 500 may generate an audio signal, based on an audio source and may amplify the audio signal to generate the vibration signal, thereby deforming (or vibrating) the vibration generating panel 300. The driving circuit unit 500 may calculate a touch position of a user touch through the touch panel 150 and may execute an application corresponding to the calculated touch position.

For example, the driving circuit unit 500 may be mounted on the display panel 110.

The cover window 600 may be coupled or connected to the housing 400 to support the display module 100. For example, the cover window 600 may support the display module 100 and may be supported by the upper stepped portion 411 in the housing sidewall 410 of the housing 400. The cover window 600 according to an embodiment of the present disclosure may be formed of glass or tempered glass material. For example, the cover window 600 may include one of sapphire glass and gorilla glass, or a stacked structure thereof. The cover window 600 may be attached (or laminated) on a front surface of the display module 100 by an adhesive member. Also, the adhesive member may be an optically clear adhesive (OCA), an optically clear resin (OCR), or a pressure sensitive adhesive (PSA).

The rear cover 700 may be coupled or connected to the housing 400 to cover a rear surface of the housing 400. For example, the rear cover 700 may cover the circuit accommodating space in the rear surface of the housing 400. To this end, the rear cover 700 may be coupled or connected to the lower stepped portion 413 in the housing sidewall 410 of the housing 400. The rear cover 700 according to an embodiment of the present disclosure may be formed of the same material as that of the cover window 600, or may be formed of glass or tempered glass material that differs from a material of the cover window 600.

Therefore, the electronic apparatus according to an embodiment of the present disclosure may vibrate the display module 100 using the vibration generating panel 300 and may output a sound SW, generated based on the vibration of the display module 100, to a forward region in front of the display module 100 to allow an image displayed by the electronic apparatus to match a sound output from the electronic apparatus, thereby increasing an immersion experience of a viewer.

Figure 3:
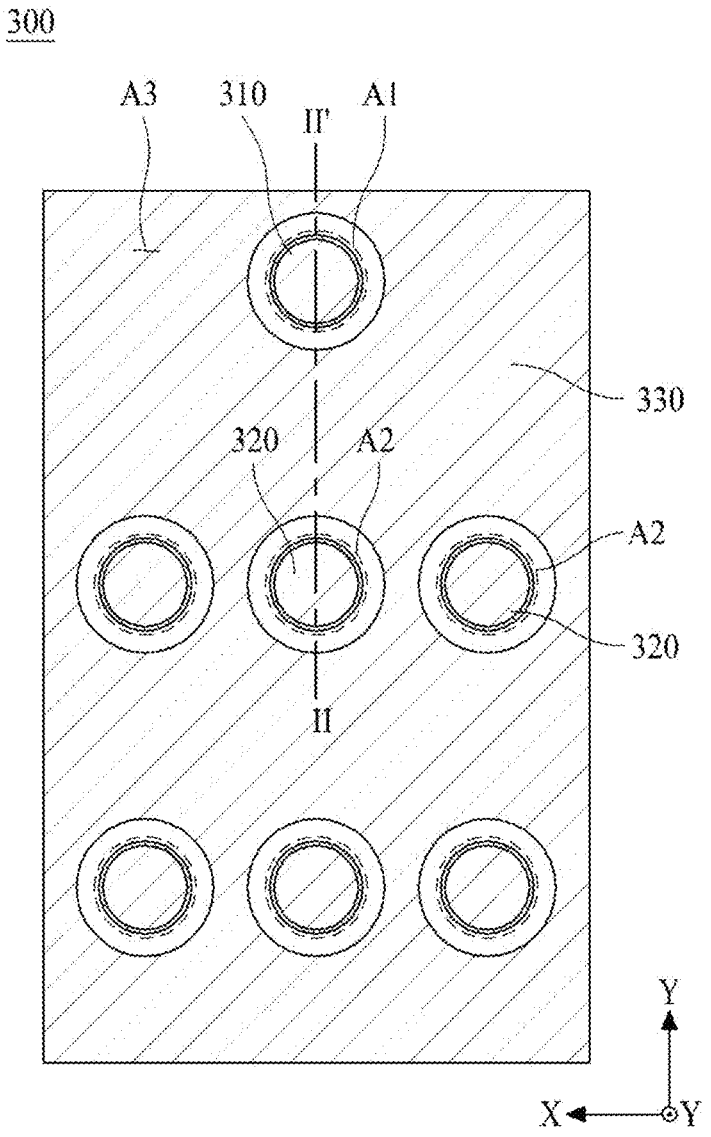
FIG. 3 is a plan view illustrating a vibration generating panel in an electronic apparatus according to an embodiment of the present disclosure.
Figure 4:
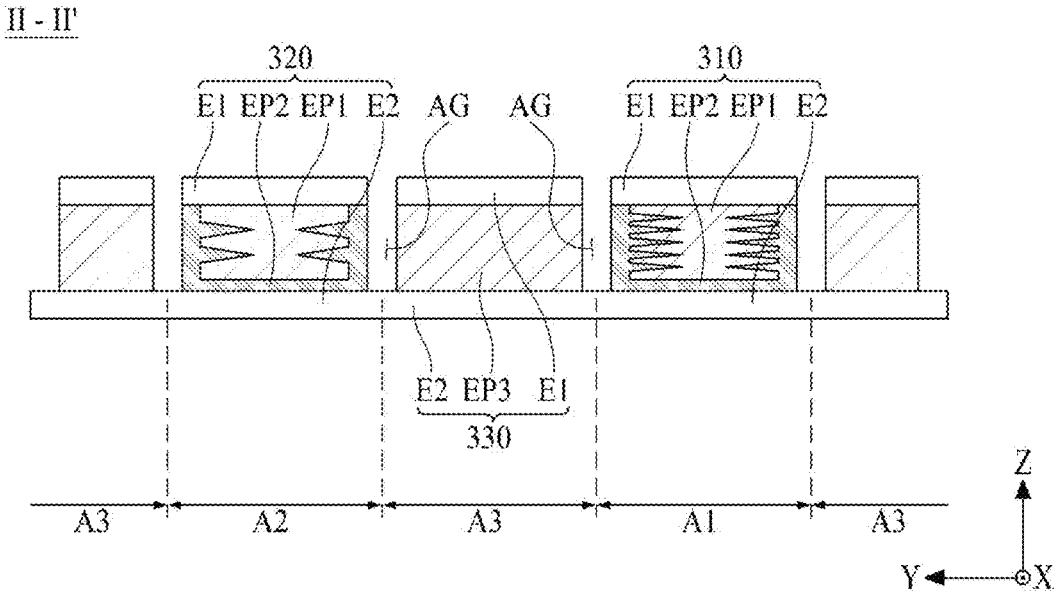
FIG. 4 is a cross-sectional view illustrating a first embodiment of a cross-sectional surface taken along line II-II' of FIG. 3.
Figure 5:
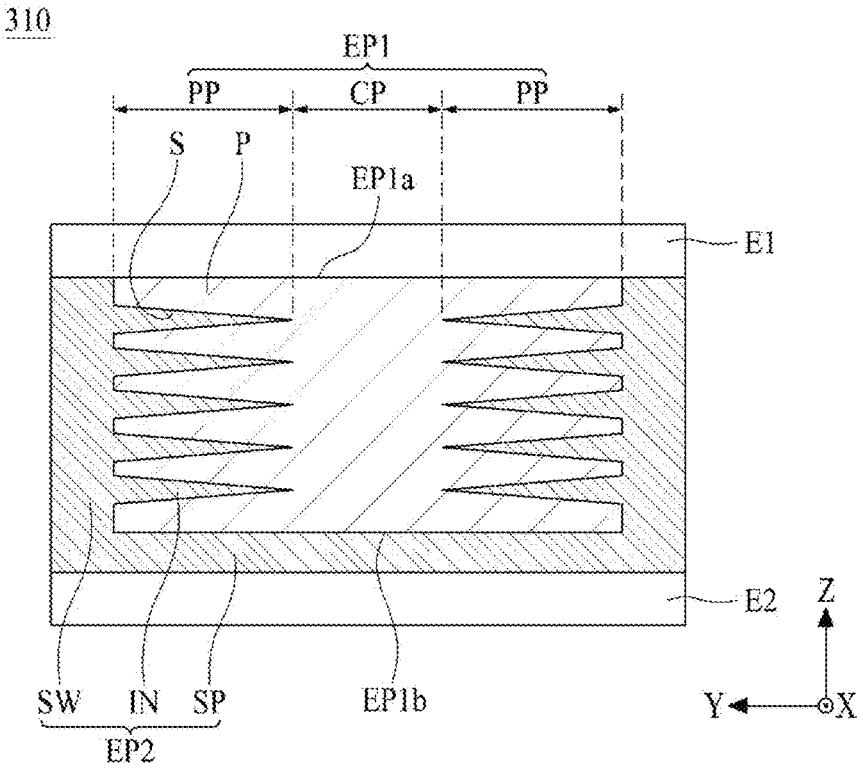
FIG. 5 is an enlarged view illustrating a first vibration generating device of FIG. 4.
Figure 6:
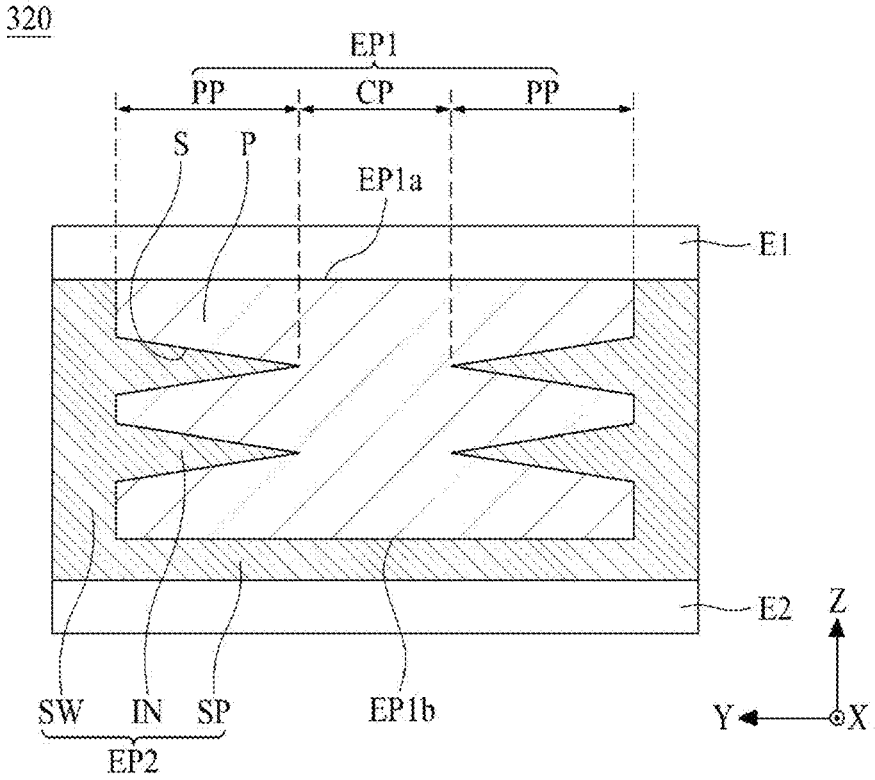
FIG. 6 is an enlarged view illustrating a second vibration generating device of FIG. 4.

FIG. 3 is a plan view illustrating a vibration generating panel in an electronic apparatus according to an embodiment of the present disclosure. FIG. 4 is a cross-sectional view illustrating a first embodiment of a cross-sectional surface taken along line II-II' of FIG. 3. FIG. 5 is an enlarged view illustrating a first vibration generating device of FIG. 4. FIG. 6 is an enlarged view illustrating a second vibration generating device of FIG. 4.

With reference to FIGS. 3 to 6, the vibration generating panel 300 according to an embodiment of the present disclosure may be on one surface of the display module 100 to vibrate the display module 100. According to an embodiment of the present disclosure, the vibration generating panel 300 may include first to third vibration generating devices 310 to 330 which are coupled or connected to a rear surface of the display module 100, for example, a rear surface of the display panel 110. Also, when the vibration generating panel 300 is applied to a mobile electronic apparatus, the vibration generating panel 300 may be used as a receiver, a speaker, and a haptic layer, but embodiments are not limited thereto. For example, when the vibration generating panel 300 is applied to a mobile electronic apparatus, the first vibration generating device 310 may act as a receiver which is used in telephone call, the second vibration generating device 320 may act as a speaker of the mobile electronic apparatus, and the third vibration generating device 330 may act as a haptic layer. As another example, the second vibration generating device 320 may be provided in plurality, and all of the plurality of second vibration devices 320 may act as speakers and may be used as a surround speaker using at least two speakers.

The first vibration generating device 310 may vibrate a first region A1 of the display module 100 according to the vibration signal supplied from the driving circuit unit 500. According to an embodiment of the present disclosure, the vibration generating device 310 may be coupled or connected to the rear surface of the display module 100 (i.e., the first region A1 of the rear surface of the display panel 110) using an adhesive member. Here, the first region A1 of the display module 100 may be a region adjacent to one portion of the display module 100 with respect to a second lengthwise direction (or a long-side direction) Y of the display module 100. For example, the first region A1 of the display module 100 may be one peripheral region of the display module 100 with respect to the second lengthwise direction Y of the display module 100. When the vibration signal is applied from the driving circuit unit 500, the first vibration generating device 310 may repeat compression and contraction based on the inverse piezoelectric effect based on the vibration signal to vibrate the first region A1 of the display module 100. Also, the first vibration generating device 310 may be spaced apart from the third vibration generating device 330 through an air gap AG between the first region A1 and a third region A3 of the display module 100.

In FIG. 5, the first vibration generating device 310 may include a first piezoelectric device EP1, a second piezoelectric device EP2, a first electrode E1, and a second electrode E2.

The first piezoelectric device EP1 may be between the first electrode E1 and the second electrode E2, and when a voltage is applied to the first and second electrodes E1 and E2, the first piezoelectric device EP1 may vibrate to output sound. According to an embodiment of the present disclosure, the driving circuit unit 500 may supply a sound signal to the first and second electrodes E1 and E2. Also, when a voltage is applied to the first and second electrodes E1 and E2, the first piezoelectric device EP1 may vibrate with a magnetic field based on the inverse piezoelectric effect. For example, second electrodes E2 of the first to third vibration generating devices 310 to 330 may be configured to share an electrode provided as one body.

The first piezoelectric device EP1 may include a center portion CP and a peripheral portion PP.

The center portion CP of the first piezoelectric device EP1 may be surrounded by the peripheral portion PP. For example, one surface EP1*a* of the center portion CP of the first piezoelectric device EP1 may contact the first electrode E1, and the other surface EP1*b* of the center portion CP may contact a supporting part SP of the second piezoelectric device EP2. Also, a side surface of the center portion CP may be surrounded by the peripheral portion PP.

The peripheral portion PP of the first piezoelectric device EP1 may include at least one slit S and a plurality of protrusion portions P.

The plurality of protrusion portions P of the first piezoelectric device EP1 may extend in a direction parallel to the first electrode E1 with the at least one slit S therebetween. Here, the at least one slit S may correspond to a concave portion correspond to each of the plurality of protrusion portions P. Also, the at least one slit S may be spaced apart from the first electrode E1 and may be provided in a direction parallel to the first electrode E1. For example, each of the plurality of protrusion portions P may extend in a horizontal direction from the center portion CP. The plurality of protrusion portions P of the first piezoelectric device EP1 may be spaced apart from one another by the at least one slit S. Also, an accommodation part IN of the second piezoelectric device EP2 may be inserted or accommodated into the slit S of the first piezoelectric device EP1. The first vibration generating device 310 may include the plurality of protrusion portions P spaced apart from one another by the at least one slit S, and thus, may increase a natural frequency of the first piezoelectric device EP1. According to an embodiment of the present disclosure, the natural frequency of the first piezoelectric device EP1 may increase in proportion to the number of a plurality of protrusion portions P. Also, when the natural frequency of the first piezoelectric device EP1 increases, a resonance frequency of the first piezoelectric device EP1 may increase, and thus, a sound output characteristic in a high frequency domain of the first piezoelectric device EP1 may be enhanced. Also, the first piezoelectric device EP1 may include a plurality of slits S and a plurality of accommodation parts IN to realize a high-order vibration mode, and thus, the first vibration generating device 310 may enhance a response characteristic in a high frequency domain (or a high-pitched sound area) and may be good in purity (or clarity) of a sound.

For example, a cross-sectional shape of the at least one slit S may be triangular in a thickness direction Z of the first piezoelectric device EP1. Also, the accommodation part IN inserted or accommodated into the at least one slit S may have a shape corresponding to the at least one slit S. Therefore, the second piezoelectric device EP2 may include an accommodation part IN having a cross-sectional shape which is triangular in the thickness direction Z of the first piezoelectric device EP1, and thus, may stably support the first piezoelectric device EP1.

According to an embodiment of the present disclosure, the first piezoelectric device EP1 may include a piezoelectric material having a piezoelectric effect. Here, the piezoelectric effect may denote a characteristic where a potential difference occurs due to electrical polarization when an external force is applied from the outside, and when a voltage is applied, deformation or stress occurs. For example, the piezoelectric material may include piezopolymer including at least one of poly vinylidene fluoride (PVDF) homopolymer, PVDF copolymer, PVDF terpolymer, cyano-polymer, cyano-copolymer, boron (BN) polymer, and boron nitride polymer, but is not limited thereto. Here, examples of the PVDF copolymer may include polyvinylidene fluoride trifluoroethylene (PVDF-TrFE), PVDF-TFE, PVDF-CTFE, and PVDF-CFE, but are not limited. Also, examples of the PVDF terpolymer may include PVDF-TrFe-CFE and PVDF-TrFE-CTFE, but are not limited thereto. Also, examples of the cyano-copolymer may include PVDCN-vinyl acetate and PVDCN-vinyl propionate, but are not limited thereto. Also, examples of the BN polymer may include polyaminoboran and polyaminodifluoroboran, but are not limited thereto.

The second piezoelectric device EP2 may act as a mold for determining a shape of the first piezoelectric device EP1. For example, a liquid mixture where a piezoelectric material is mixed with a solvent may be applied into the second piezoelectric device EP2, and then, the first piezoelectric device EP1 may be formed through a curing process. Therefore, a shape of the first piezoelectric device EP1 may be determined based on that of the second piezoelectric device EP2. According to an embodiment of the present disclosure, a shape of the first piezoelectric device EP1 may be determined based on a shape of a supporting part SP, a sidewall SW, and an accommodation part IN of the second piezoelectric device EP2.

The second piezoelectric device EP2 may include the supporting part SP, the sidewall SW, and the accommodation part IN.

The supporting part SP of the second piezoelectric device EP2 may support the first piezoelectric device EP1. For example, one surface of the supporting part SP of the second piezoelectric device EP2 may contact the other surface EP1*b* of the first piezoelectric device EP1, and the other surface of the supporting part SP of the second piezoelectric device EP2 may contact the second electrode E2. Also, the supporting part SP may support the sidewall SW that is provided along an outer portion of the supporting part SP.

The sidewall SW of the second piezoelectric device EP2 may be on the outer portion of the supporting part SP, and may surround the first piezoelectric device EP1. Also, the sidewall SW of the second piezoelectric device EP2 may contact a side surface of each of the plurality of protrusion portions P of the first piezoelectric device EP1.

The accommodation part IN of the second piezoelectric device EP2 may extend from an inner surface of the sidewall SW and may fill the at least one slit S of the first piezoelectric device EP1. According to an embodiment of the present disclosure, the accommodation part IN of the second piezoelectric device EP2 may separate the plurality of protrusion portions P of the first piezoelectric device EP1 adjacent to each other. Each of the plurality of protrusion portions P and the accommodation part IN may overlap each other in the thickness direction Z of the first piezoelectric device EP1. For example, the accommodation part IN of the second piezoelectric device EP2 may act as a node which increases a natural frequency of the plurality of protrusion portions P. Here, the number of nodes may be inversely proportional to a wavelength of a natural vibration of the first piezo electric device EP1 and may be proportional to a frequency of the natural vibration of the first piezo electric device EP1. Therefore, a natural frequency of the first piezoelectric device EP1 may increase in proportion to the number of accommodation parts IN or nodes of the second piezoelectric device EP2. Also, when the natural frequency of the first piezoelectric device EP1 increases, a resonance frequency of the first piezoelectric device EP1 may increase, and thus, a sound output characteristic may be enhanced in a high frequency domain of the first piezoelectric device EP1. Accordingly, the first vibration generating device 310 may enhance a response characteristic in the high frequency domain (or the high-pitched sound area) and may be good in purity (or clarity) of a sound. As a result, the first vibration generating device 310 may include the first and second piezoelectric devices EP1 and EP2 including different materials, and thus, may have a response characteristic which is better in the high frequency domain than an electronic apparatus including a single piezoelectric device.

For example, the second piezoelectric device EP2 may be formed of a synthetic polymer including at least one of cellulose, polypropylene, and Kevlar. According to an embodiment of the present disclosure, the first piezoelectric device EP1 may be formed of a material which is higher in piezoelectric properties than the second piezoelectric device EP2.

With reference again to FIG. 4, the second vibration generating device 320 may vibrate a plurality of second regions A2 of the display module 100 according to the vibration signal supplied from the driving circuit unit 500. According to an embodiment of the present disclosure, a plurality of second vibration generating devices 320 may be spaced apart from one another and may respectively vibrate the plurality of second regions A2 of the display module 100. According to an embodiment of the present disclosure, the second vibration generating device 320 may be coupled or connected to the rear surface of the display module 100, i.e., the second region A2 defined in the rear surface of the display panel 110, using an adhesive member. Here, the second region A2 of the display module 100 may be a region adjacent to a center region of the display module 100 and the other portion of the display module 100 except the first region A1 with respect to the second lengthwise direction Y of the display module 100. For example, the plurality of second regions A2 of the display module 100 may be in the center region of the display module 100 with respect to the second lengthwise direction Y of the display module 100 and may be arranged in the first lengthwise direction X of the display module 100. Also, for example, the plurality of second regions A2 of the display module 100 may be in the other peripheral region of the display module 100 except the first region A1 with respect to the second lengthwise direction Y of the display module 100 and may be arranged in the first lengthwise direction X of the display module 100. When the vibration signal is applied from the driving circuit unit 500, the second vibration generating device 320 may repeat compression and contraction based on the inverse piezoelectric effect based on the vibration signal to vibrate the second region A2 of the display module 100. Also, the second vibration generating device 320 may be spaced apart from the third vibration generating device 330 through an air gap AG between the second region A2 and the third region A3 of the display module 100.

In FIG. 6, the second vibration generating device 320 may include a first piezoelectric device EP1, a second piezoelectric device EP2, a first electrode E1, and a second electrode E2.

The first piezoelectric device EP1 of the second vibration generating device 320 may be between the first electrode E1 and the second electrode E2, and when a voltage is applied to the first and second electrodes E1 and E2, the first piezoelectric device EP1 may vibrate to output sound. Also, the first piezoelectric device EP1 of the second vibration generating device 320 may include a center portion CP and a peripheral portion PP. The peripheral portion PP of the first piezoelectric device EP1 may include at least one slit S and a plurality of protrusion portions P.

The plurality of protrusion portions P of the first piezoelectric device EP1 may extend in a direction parallel to the first electrode E1 with the at least one slit S therebetween. Also, the at least one slit S may be spaced apart from the first electrode E1, and may be provided in a direction parallel to the first electrode E1.

The second piezoelectric device EP2 may include a supporting part SP, a sidewall SW, and an accommodation part IN. The supporting part SP of the second piezoelectric device EP2 may support the first piezoelectric device EP1, and the sidewall SW of the second piezoelectric device EP2 may be at an outer portion of the supporting part SP and may surround the first piezoelectric device EP1. The accommodation part IN of the second piezoelectric device EP2 may extend from an inner surface of the sidewall SW and may fill the at least one slit S.

For example, the first piezoelectric devices EP1 of the first and second vibration generating devices 310 and 320 may be formed of the same material, and the second piezoelectric devices EP2 of the first and second vibration generating device 310 and 320 may be formed of the same material.

With reference to FIGS. 4 to 6, the first vibration generating device 310 may include more slits S than the number of slits S in the second vibration generating device 320. Therefore, the first vibration generating device 310 may include more protrusion portions P and accommodation parts IN than the number of protrusion portions P and accommodation parts IN in the second vibration generating module 320. Accordingly, a natural frequency and a resonance frequency of the first vibration generating module 310 may be greater than a natural frequency and a resonance frequency of the second vibration generating module 320, and the first vibration generating module 310 may have a response characteristic of a high-order vibration mode (or a high-order resonance mode) compared to the second vibration generating module 320. Here, the number of slits S in each of the first and second vibration generating devices 310 and 320 may be determined based on a response characteristic corresponding to a frequency domain.

According to an embodiment of the present disclosure, the first vibration generating device 310 may have an excellent response characteristic in a high frequency domain (or a high-pitched sound band) of 5 kHz or higher, and the second vibration generating device 320 may have an excellent response characteristic in a middle-low frequency domain (or a middle-low-pitched sound band) of 200 Hz to 5 kHz. Therefore, the electronic apparatus according to an embodiment of the present disclosure may include the vibration generating panel 300 including the first and second vibration generating devices 310 and 320, and thus, a receiver and a speaker may be integrated. As a result, the electronic apparatus according to an embodiment of the present disclosure may include the first and second vibration generating devices 310 and 320 including a different number of slits S, and thus, may have a response characteristic which is better in various frequency domains than an electronic apparatus including a single vibration generating device. Also, since the electronic apparatus according to an embodiment of the present disclosure includes the first and second vibration generating devices 310 and 320 including a different number of slits S, the vibration generating panel 300 may be simply and easily manufactured.

With reference to FIG. 4, the third vibration generating device 330 may vibrate a third region A3 of the display module 100 according to the vibration signal supplied from the driving circuit unit 500. According to an embodiment of the present disclosure, the third vibration generating device 330 may be coupled or connected to the rear surface of the display module 100, i.e., the third region A3 of the rear surface of the display panel 110 using an adhesive member. Here, the third region A3 may be a region except the first region A1 and the second regions A2 of the display module 100. For example, the third region A3 may surround the first region A1 and the plurality of second regions A2. When the vibration signal is applied from the driving circuit unit 500, the third vibration generating device 330 may repeat compression and contraction based on the inverse piezoelectric effect based on the vibration signal to vibrate the third region A3 of the display module 100.

The third vibration generating device 330 may include a third piezoelectric device EP3, a first electrode E1, and a second electrode E2

The third piezoelectric device EP3 of the third vibration generating device 330 may be formed of the same material as that of the first piezoelectric device EP1. The third piezoelectric device EP3 of the third vibration generating device 330 may be between the first electrode E1 and the second electrode E2, and when a voltage is applied to the first and second electrodes E1 and E2, the third piezoelectric device EP3 may vibrate to output sound.

The third vibration generating device 330 may include the third piezoelectric device EP3 between the first and second electrodes E1 and E2 and may not include a piezoelectric device other than the third piezoelectric device EP3, and thus, may not include a separate element for acting as a node. For example, the third vibration generating device 330 may have a response characteristic of a first-order vibration mode (or a first-order resonance mode). Accordingly, the third vibration generating device 330 may not include a separate piezoelectric device other than the third piezoelectric device EP3, and thus, may have an excellent response characteristic in a low frequency domain (or a low-pitched sound band).

According to an embodiment of the present disclosure, the third vibration generating device 330 may vibrate the display module 100 according to the vibration signal supplied from the driving circuit unit 500, and thus, may provide a haptic effect (or a haptic feedback) to a forward region Z in front of the display module 100 based on the vibration of the display module 100. For example, the driving circuit unit 500 may provide the third vibration generating device 330 with the vibration signal (or a haptic signal) corresponding to a position of a human body contacting the third vibration generating device 330, and the third vibration generating device 330 may generate a haptic vibration at the position of the human body contacting the third vibration generating device 330. For example, the third vibration generating device 330 may vibrate the display module 100 based on the inverse piezoelectric effect based on the vibration signal (or the haptic signal).

According to an embodiment of the present disclosure, the first vibration generating device 310 may have an excellent response characteristic in a high frequency domain (or a high-pitched sound band) of 5 kHz or higher, the second vibration generating device 320 may have an excellent response characteristic in a middle-low frequency domain (or a middle-low-pitched sound band) of 200 Hz to 5 kHz, and the third vibration generating device 330 may have an excellent response characteristic in the low frequency domain (or a low-pitched sound band) of 200 Hz or less. Therefore, the electronic apparatus according to an embodiment of the present disclosure may include the vibration generating panel 300 including the first to third vibration generating devices 310 to 330, and thus, a receiver, a speaker, and a haptic layer may be integrated. As a result, since the electronic apparatus according to an embodiment of the present disclosure includes the first and second vibration generating devices 310 and 320 including a different number of slits S and the third vibration generating module 330 including no slit, the electronic apparatus may have a response characteristic which is better in various frequency domains than an electronic apparatus including a single vibration generating device, and the vibration generating panel 300 may be simply and easily manufactured.

Figure 7:
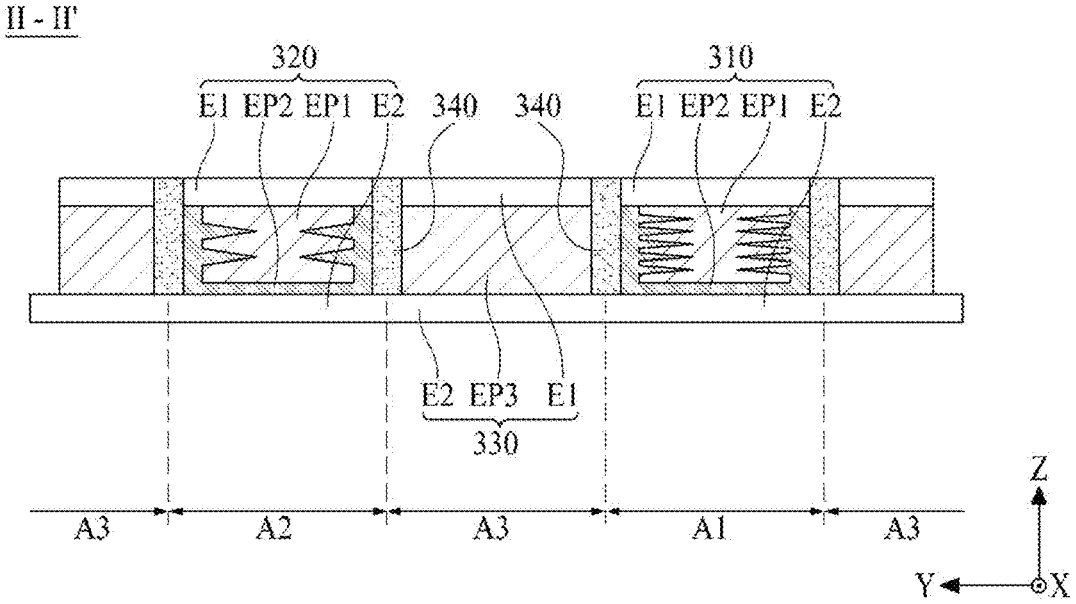
FIG. 7 is a cross-sectional view illustrating a second embodiment of a cross-sectional surface taken along line II-II' of FIG. 3.

FIG. 7 is a cross-sectional view illustrating a second embodiment of a cross-sectional surface taken along line II-II' of FIG. 3. A vibration generating panel 300 illustrated in FIG. 7 may further include a sound absorbing member 340, and thus, descriptions of the same elements as the above-described elements are omitted or will be briefly given below.

With reference to FIG. 7, the vibration generating panel 300 according to an embodiment of the present disclosure may further include a sound absorbing member 340 which is disposed between a first region A1 and a third region A3 of the display module 100 and between a second region A2 and the third region A3 of the display module 100.

The sound absorbing member 340 may be between the first region A1 and the third region A3 of the display module 100 to surround a first vibration generating device 310 and may reduce or prevent interference caused by a vibration generated by each of the first vibration generating device 310 and a third vibration generating device 330. Also, the sound absorbing member 340 may be between the second region A2 and the third region A3 of the display module 100 to surround a second vibration generating device 320 and may reduce or prevent interference caused by a vibration generated by each of the second and third vibration generating devices 320 and 330. For example, the sound absorbing member 340 may attenuate or absorb a vibration generated by each of the first to third vibration generating devices 310 to 330 to reduce or prevent a vibration generated by one vibration generating device from being transferred to another vibration generating device adjacent thereto. Therefore, the sound absorbing member 340 may prevent interference between vibrations generated in the vibration generating panel 300 and may enhance a sound output characteristic of a sound output from the vibration generating panel 300, thereby enhancing a sound pressure level (SPL). According to an embodiment of the present disclosure, the sound absorbing member 340 may correspond to an enclosure or a baffle, but the term is not limited thereto.

According to an embodiment of present disclosure, the sound absorbing member 340 may include a material which has low elasticity, and thus, may absorb a vibration generated by each of the first to third vibration generating devices 310 to 330. For example, the sound absorbing member 340 may be implemented with a foam pad, and thus, may reduce or prevent the leakage of the vibration generated by each of the first to third vibration generating devices 310 to 330.

Figure 8A:
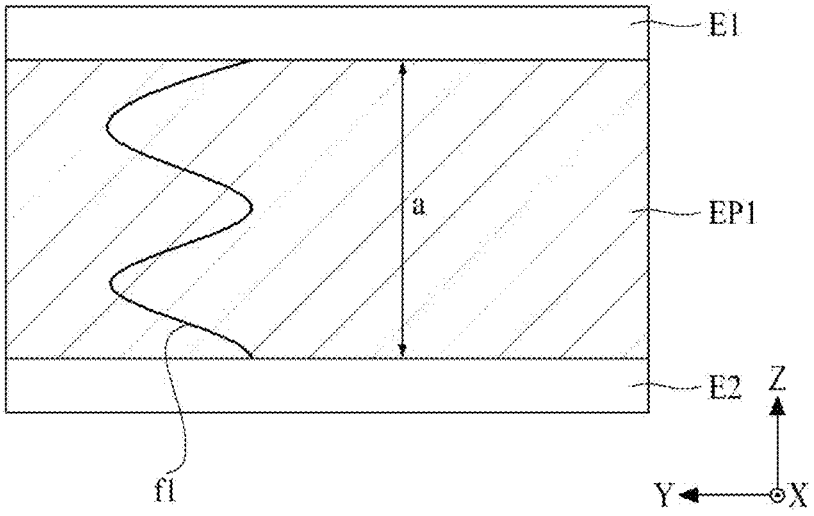
FIGS. 8A-8C are cross-sectional views for describing a resonance frequency of a first piezoelectric device in an electronic apparatus according to an embodiment of the present disclosure.
Figure 8B:
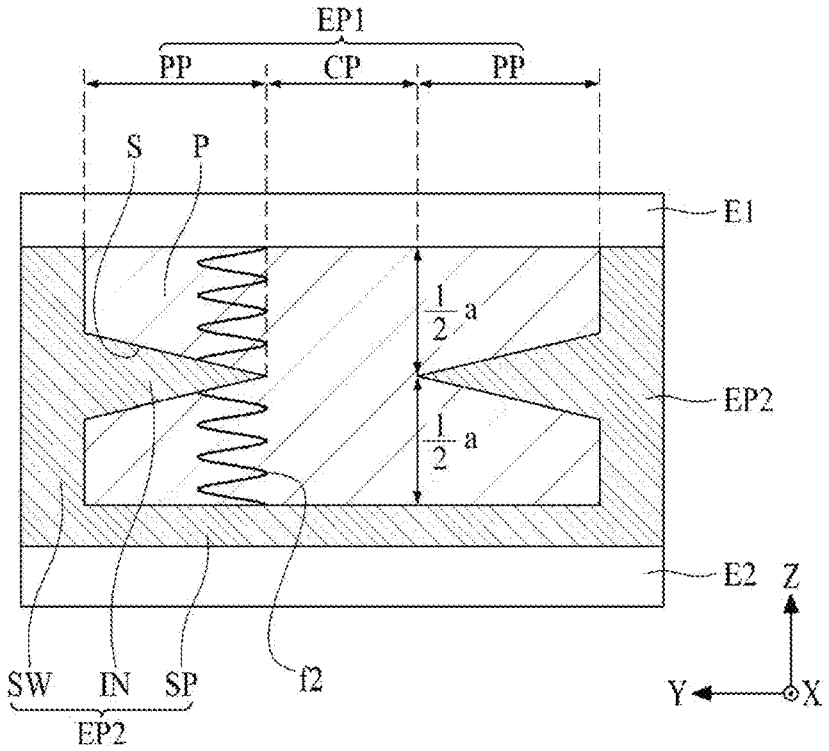
Figure 8C:
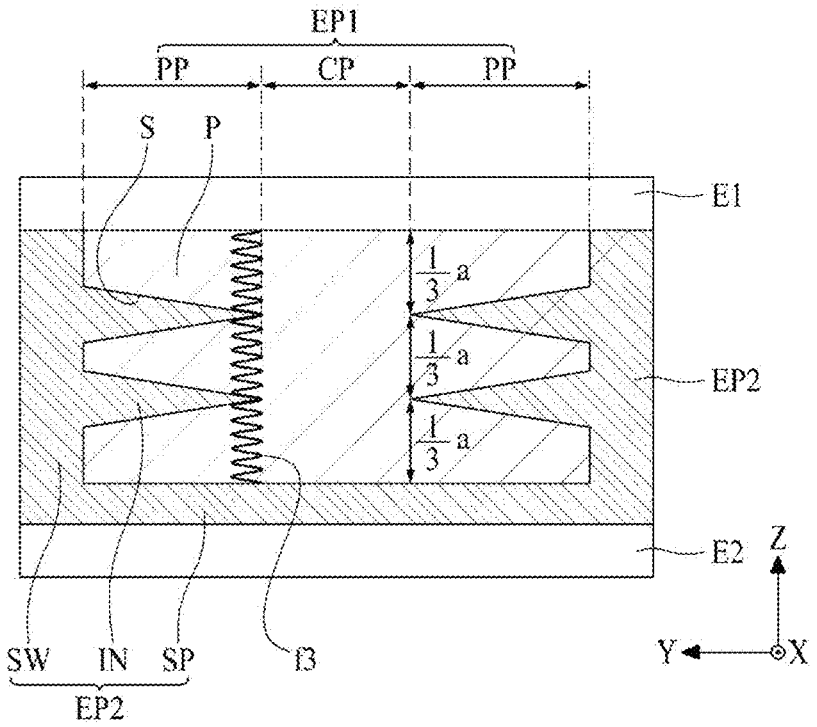

FIGS. 8A-8C are cross-sectional views for describing a resonance frequency of a first piezoelectric device in an electronic apparatus according to an embodiment of the present disclosure. For example, FIG. 8A shows a resonance frequency corresponding to a first piezoelectric device EP1 between first and second electrodes E1 and E2, FIG. 8B shows a resonance frequency corresponding to a first piezoelectric device EP1 including one slit S, and FIG. 8C shows a resonance frequency corresponding to a first piezoelectric device EP1 including two slits S.

In FIG. 8A, a vibration generating device may include a first piezoelectric device EP1 which is disposed between first and second electrodes E1 and E2 to have a first length "a". For example, the vibration generating device may not include another piezoelectric device other than the first piezoelectric device EP1, and thus, may not include a separate element for acting as a node. Therefore, the vibration generating device may have a response characteristic of the first-order vibration mode (or the first-order resonance mode) and may have an excellent response characteristic in the low frequency domain (or a low-pitched sound band). Accordingly, the vibration generating device of FIG. 8A may have a first-order resonance frequency f1.

In FIG. 8B, a vibration generating device may include a first piezoelectric device EP1 including one slit S. Therefore, the vibration generating device may include one accommodation part IN, and the accommodation part IN may act as a node. Accordingly, the vibration generating device may include one node, and thus, may have a response characteristic of a second-order vibration mode (or a second-order resonance mode).

According to an embodiment of the present disclosure, surfaces of a plurality of protrusion portions P facing a center portion CP may have the same thickness (or length). For example, the one surface of each of the plurality of protrusion portions P facing the center portion CP may have a second length "½a", and the second length "½a" may correspond to half of the first length "a". Here, the plurality of protrusion portions P may be provided as two, based on the one accommodation part IN acting as the node, and since a space where each of the two protrusion portions vibrates is reduced, a resonance frequency of the first piezoelectric device EP1 may increase. As a result, the vibration generating device of FIG. 8B may have a second-order resonance frequency f2, and the second-order resonance frequency f2 of FIG. 8B may be twice the first-order resonance frequency f1 of FIG. 8A.

In FIG. 8C, a vibration generating device may include a first piezoelectric device EP1 including two slits S. Therefore, the vibration generating module may include two accommodation parts IN, and each of the accommodation parts IN may act as a node. Accordingly, the vibration generating device may include two nodes, and thus, may have a response characteristic of a third-order vibration mode (or a third-order resonance mode).

According to an embodiment of the present disclosure, surfaces of a plurality of protrusion portions P facing a center portion CP may have the same thickness (or length). For example, the one surface of each of the plurality of protrusion portions P facing the center portion CP may have a third length "⅓a", and the third length "⅓a" may correspond to one-third (⅓) of the first length "a". Here, the plurality of protrusion portions P may be provided as three, based on the two accommodation parts IN acting as the nodes, and since a space where each of the three protrusion portions vibrates is reduced, a resonance frequency of the first piezoelectric device EP1 may increase. As a result, the vibration generating device of FIG. 8C may have a third-order resonance frequency f3, and the third-order resonance frequency f3 of FIG. 8C may be three times the first-order resonance frequency f1 of FIG. 8A. Also, the third-order resonance frequency f3 of FIG. 8C may be 3/2 times the second-order resonance frequency f2 of FIG. 8B. For example, when the first-order resonance frequency f1 is 30 Hz, the second-order resonance frequency f2 may correspond to 60 Hz and the third-order resonance frequency f3 may correspond to 90 Hz.

Figure 9:
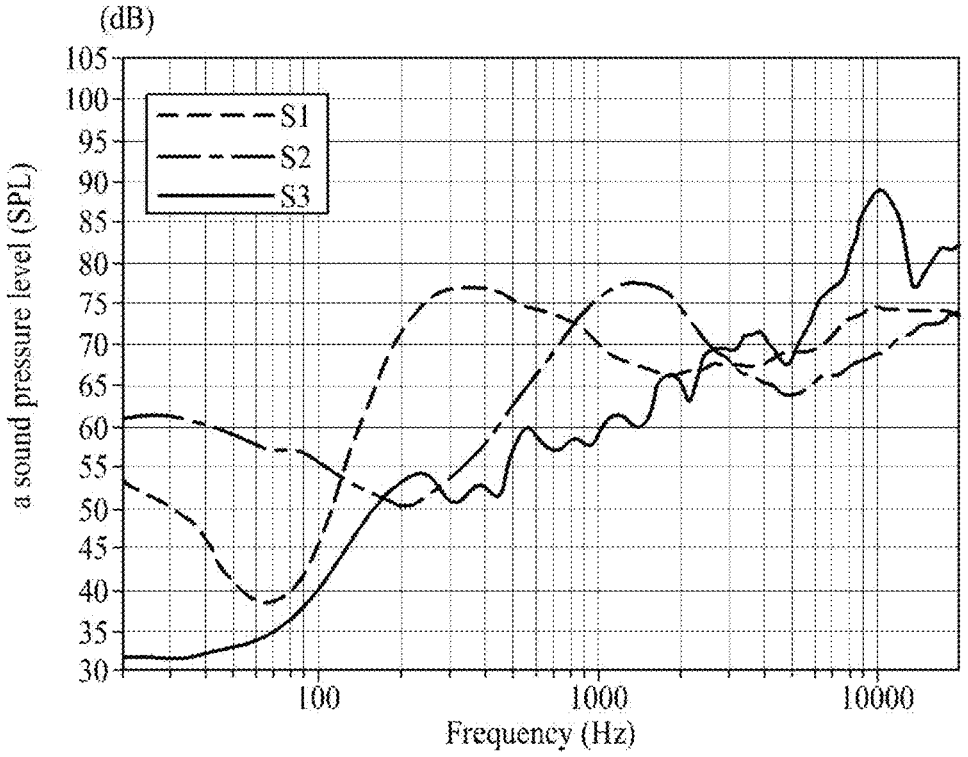
FIG. 9 is a graph showing a sound pressure level of each vibration generating device illustrated in FIGS. 8A-8C.

FIG. 9 is a graph showing a sound pressure level of each of the vibration generating devices illustrated in FIGS. 8A-8C. Here, a first structure S1 corresponds to the vibration generating device illustrated in FIG. 8A, a second structure S2 corresponds to the vibration generating device illustrated in FIG. 8B, and a third structure S3 corresponds to the vibration generating device illustrated in FIG. 8C. Also, a sound pressure level (SPL) or a response characteristic of a vibration generating device according to an embodiment of the present disclosure is not limited to a result of FIG. 9, and a response characteristic of the vibration generating device may vary based on the number of slits S, a shape of each slit S, and the thickness, disposition relationship, and material of each of first and second piezoelectric devices EP1 and EP2.

With reference to FIG. 9, the first structure S1 may not include another piezoelectric device other than the first piezoelectric device EP1, and thus, may have a response characteristic of the first-order vibration mode (or the first-order resonance mode) and may have an excellent response characteristic in the low frequency domain. For example, the first structure S1 may have an excellent response characteristic in a frequency domain of 200 Hz to 800 Hz.

Moreover, the second structure S2 may include a first piezoelectric device EP1 including one slit S, and thus, may have a response characteristic of the second-order vibration mode (or the second-order resonance mode) and may have an excellent response characteristic in a middle-low frequency domain (or a middle-low-pitched sound band). For example, the second structure S2 may have an excellent response characteristic in a frequency domain of 800 Hz to 3 kHz.

Moreover, the third structure S3 may include a first piezoelectric device EP1 including two slits S, and thus, may have a response characteristic of the third-order vibration mode (or the third-order resonance mode) and may have an excellent response characteristic in the high frequency domain (or a high-pitched sound band). For example, the third structure S3 may have an excellent response characteristic in a frequency domain of 3 kHz or higher.

As described above, since the electronic apparatus according to an embodiment of the present disclosure includes the first and second vibration generating devices 310 and 320 including a different number of slits S and the third vibration generating device 330 including no slit, the electronic apparatus may have a response characteristic which is better in various frequency domains than an electronic apparatus including a single vibration generating device, and the vibration generating panel 300 may be simply and easily manufactured.

Figure 10:
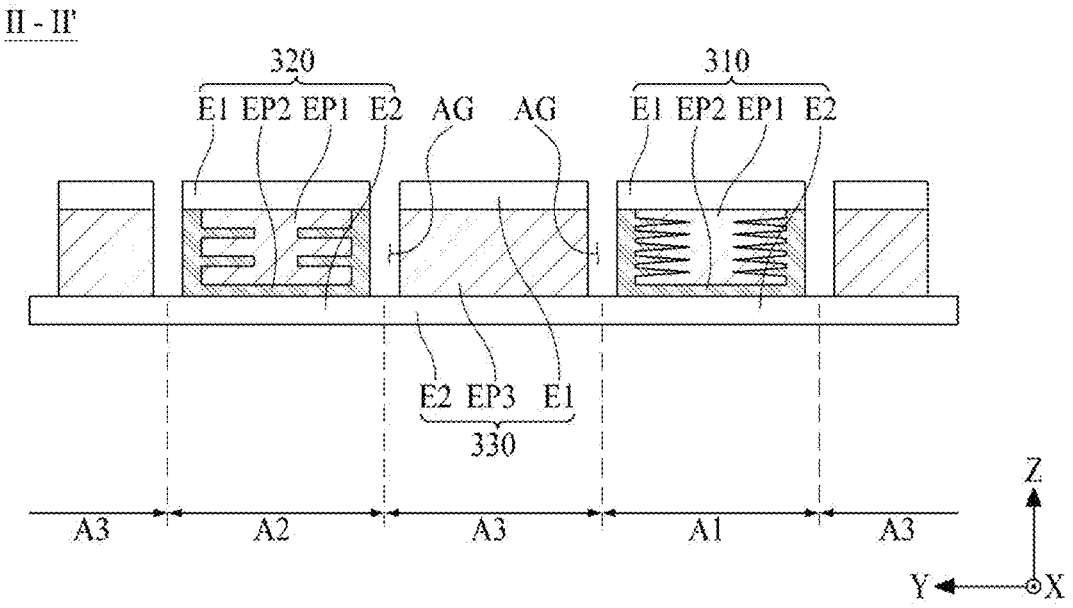
FIG. 10 is a cross-sectional view illustrating a third embodiment of a cross-sectional surface taken along line II-II' of FIG. 3.
Figure 11:
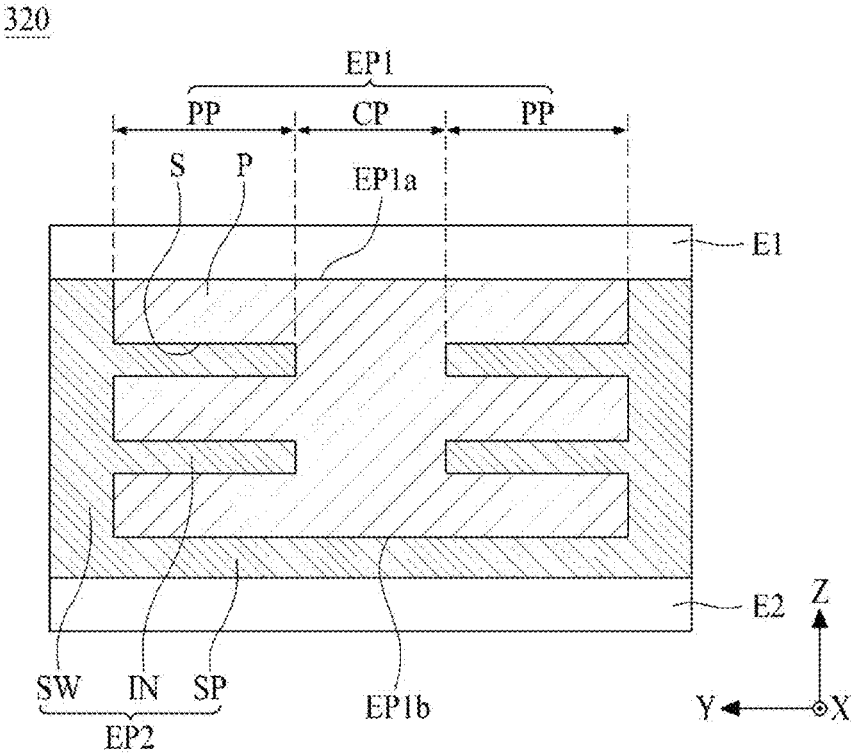
FIG. 11 is an enlarged view illustrating a second vibration generating device of FIG. 10.

FIG. 10 is a cross-sectional view illustrating a third embodiment of a cross-sectional surface taken along line II-II' of FIG. 3, and FIG. 11 is an enlarged view illustrating a second vibration generating device of FIG. 10. Except for that only a configuration of a second vibration generating device 320 is modified, a configuration of a vibration generating panel 300 illustrated in FIGS. 10 and 11 is the same as the above-described configuration, and thus, its description is omitted or will be briefly given below.

The first vibration generating device 310 may include a first piezoelectric device EP1, a second piezoelectric device EP2, a first electrode E1, and a second electrode E2. The first piezoelectric device EP1 may include a center portion CP and a peripheral portion PP. The peripheral portion PP of the first piezoelectric device EP1 may include at least one slit S and a plurality of protrusion portions P. Also, the second piezoelectric device EP2 may include a supporting part SP, a sidewall SW, and an accommodation part IN.

According to an embodiment of the present disclosure, a cross-sectional shape of the at least one slit S of the first piezoelectric device EP1 may be triangular in a thickness direction Z of the first piezoelectric device EP1. Also, the accommodation part IN inserted or accommodated into the at least one slit S may have a shape corresponding to the at least one slit S. Therefore, the second piezoelectric device EP2 may include an accommodation part IN having a cross-sectional shape which is triangular in the thickness direction Z of the first piezoelectric device EP1, and thus, may stably support the first piezoelectric device EP1.

The second vibration generating device 320 may include a first piezoelectric device EP1, a second piezoelectric device EP2, a first electrode E1, and a second electrode E2. The first piezoelectric device EP1 may include a center portion CP and a peripheral portion PP. The peripheral portion PP of the first piezoelectric device EP1 may include at least one slit S and a plurality of protrusion portions P. Also, the second piezoelectric device EP2 may include a supporting part SP, a sidewall SW, and an accommodation part IN.

According to an embodiment of the present disclosure, a cross-sectional shape of the at least one slit S of the first piezoelectric device EP1 may be tetragonal (e.g., quadrilateral) in a thickness direction Z of the first piezoelectric device EP1. Also, the accommodation part IN inserted or accommodated into the at least one slit S may have a shape corresponding to the at least one slit S. Therefore, the second piezoelectric device EP2 may include an accommodation part IN having a cross-sectional shape which is tetragonal (e.g., quadrilateral) in the thickness direction Z of the first piezoelectric device EP1, and thus, may be good in purity (or clarity) of a sound.

The electronic apparatus according to an embodiment of the present disclosure may be applied to mobile devices, video phones, smart watches, watch phones, wearable apparatuses, foldable apparatuses, rollable apparatuses, bendable apparatuses, flexible apparatuses, curved apparatuses, portable multimedia players (PMPs), personal digital assistants (PDAs), electronic organizers, desktop personal computers (PCs), laptop PCs, netbook computers, workstations, navigation apparatuses, automotive navigation apparatuses, automotive display apparatuses, TVs, wall paper display apparatuses, signage apparatuses, game machines, notebook computers, monitors, cameras, camcorders, home appliances, etc.

A vibration generating device and an electronic apparatus including the same according to an embodiment of the present disclosure will be described below.

According to an embodiment of the present disclosure, a vibration generating device includes a first piezoelectric device including at least one slit, a first electrode on a first surface of the first piezoelectric device, and a second electrode on a second surface opposite to the first surface of the first piezoelectric device.

For example, a vibration generating device according to an embodiment of the present disclosure may further include a second piezoelectric device including an accommodation part accommodated into the at least one slit and covering the second surface of the first piezoelectric device, the second electrode may be on a second surface opposite to a first surface of the second piezoelectric device facing the first piezoelectric device. For example, in a vibration generating device according to an embodiment of the present disclosure, the first piezoelectric device may include a peripheral portion with the at least one slit therein and a center portion surrounded by the peripheral portion.

For example, in a vibration generating device according to an embodiment of the present disclosure, the peripheral portion of the first piezoelectric device may include a plurality of protrusions extending in a direction parallel to the first electrode with the at least one slit therebetween.

For example, in a vibration generating device according to an embodiment of the present disclosure, each of the plurality of protrusions and the accommodation part may overlap in a thickness direction of the first piezoelectric device.

For example, in a vibration generating device according to an embodiment of the present disclosure, the at least one slit of the first piezoelectric device may be spaced apart from the first electrode and extend in a direction parallel to the first electrode.

For example, in a vibration generating device according to an embodiment of the present disclosure, the second piezoelectric device may further include a supporting part between the first piezoelectric device and the second electrode and a sidewall between the supporting part and the first electrode to surround the first piezoelectric device, and the accommodation part may extend from an inner surface of the sidewall and fills the at least one slit.

For example, in a vibration generating device according to an embodiment of the present disclosure, the second piezoelectric device may act as a mold for forming the first piezoelectric device.

For example, in a vibration generating device according to an embodiment of the present disclosure, the at least one slit may have a cross-sectional shape that is triangular in a thickness direction of the first piezoelectric device.

For example, in a vibration generating device according to an embodiment of the present disclosure, the at least one slit may have a cross-sectional shape that is tetragonal in a thickness direction of the first piezoelectric device.

For example, in a vibration generating device according to an embodiment of the present disclosure, the first piezoelectric device may include piezopolymer including at least one of poly vinylidene fluoride (PVDF) homopolymer, PVDF copolymer, PVDF terpolymer, cyano-polymer, cyano-copolymer, boron (BN) polymer, and boron nitride polymer.

For example, in a vibration generating device according to an embodiment of the present disclosure, the second piezoelectric device may include a synthetic polymer including at least one of cellulose, polypropylene, and Kevlar.

For example, in a vibration generating device according to an embodiment of the present disclosure, the first piezoelectric device may include a material which is higher in piezoelectric properties than the second piezoelectric device.

According to an embodiment of the present disclosure, an electronic apparatus includes a display module configured to display an image and a vibration generating panel including at least one vibration generating device on one surface of the display module, wherein the vibration generating device includes a first piezoelectric device including at least one slit, a first electrode on a first surface of the first piezoelectric device, a second piezoelectric device including an accommodation part accommodated into the at least one slit and covering a second surface opposite to the first surface of the first piezoelectric device, and a second electrode on a second surface opposite to a first surface of the second piezoelectric device facing the first piezoelectric device.

For example, in an electronic apparatus according to an embodiment of the present disclosure, the vibration generating panel may include a first vibration generating device overlapping a first region of the display module, and a second vibration generating device overlapping each of a plurality of second regions spaced apart from the first region.

For example, in an electronic apparatus according to an embodiment of the present disclosure, each of the first and second vibration generating devices may include the first piezoelectric device, the first electrode, the second piezoelectric device, and second electrode, and the first vibration generating device may include more slits than number of slits of the second vibration generating device.

For example, in an electronic apparatus according to an embodiment of the present disclosure, the vibration generating panel may further include a third vibration generating device overlapping a third region surrounding the first region and the plurality of second regions.

For example, in an electronic apparatus according to an embodiment of the present disclosure, the third vibration generating device may include a third piezoelectric device including the same material as a material of the first piezoelectric device, a first electrode on a first surface of the third piezoelectric device, and a second electrode on a second surface opposite to the first surface of the third piezoelectric device.

For example, in an electronic apparatus according to an embodiment of the present disclosure, each of the first and second vibration generating devices may include a plurality of protrusion portions extending in a direction parallel to the first electrode with the at least one slit therebetween, and the first vibration generating device may include more protrusion portions than number of protrusion portions of the second vibration generating device.

For example, in an electronic apparatus according to an embodiment of the present disclosure, the first vibration generating device may include more accommodation parts than number of accommodation parts of the second vibration generating device.

For example, in an electronic apparatus according to an embodiment of the present disclosure, the second electrodes of the first to third vibration generating devices may share an electrode provided as one body.

For example, an electronic apparatus according to an embodiment of the present disclosure may further include a sound absorbing member between the first region and the third region and between the second region and the third region.

For example, an electronic apparatus according to an embodiment of the present disclosure may further include an air gap between the first region and the third region and between the second region and the third region.

For example, in an electronic apparatus according to an embodiment of the present disclosure, the first region may be one peripheral region of the display module, the plurality of second regions may be in center region of the display module, and the third region may be a region except the first region and the second regions of the display module.

The vibration generating device according to an embodiment of the present disclosure may include a first piezoelectric device including at least one slit and a second piezoelectric device including an accommodation part accommodated into the at least one slit, thereby enhancing an output characteristic in a high frequency domain.

Moreover, the vibration generating device according to an embodiment of the present disclosure may include a first piezoelectric device including a plurality of protrusion portions and a second piezoelectric device including an accommodation part overlapping each of the plurality of protrusion portions in a thickness direction of the first piezoelectric device, thereby enhancing a sound pressure level in an audible frequency domain.

Moreover, the electronic apparatus according to an embodiment of the present disclosure may include a vibration generating panel including first and second vibration generating devices including a different number of slits, thereby integrating a receiver and a speaker.

Moreover, the electronic apparatus according to an embodiment of the present disclosure may include a vibration generating panel including first and second vibration generating devices including first and second piezoelectric devices and a third vibration generating device including a third piezoelectric device, thereby integrating a receiver, a speaker, and a haptic layer.

It will be apparent to those skilled in the art that various modifications and variations may be made in the vibration generating device and the electronic device including the same of the present disclosure without departing from the technical idea or scope of the disclosures. Thus, it is intended that embodiments of the present disclosure cover the modifications and variations of the disclosure provided they come within the scope of the appended claims and their equivalents.

What is claimed is:

1. A vibration generating device, comprising:

a first piezoelectric device including at least one slit;

a first electrode on a first surface of the first piezoelectric device;

a second electrode on a second surface opposite to the first surface of the first piezoelectric device, wherein the at least one slit of the first piezoelectric device is disposed between the first electrode and the second electrode, and is configured to be concave from a lateral side surface of the first piezoelectric device.

2. The vibration generating device of claim 1, further comprising:

a second piezoelectric device including an accommodation part accommodated into the at least one slit and covering the second surface of the first piezoelectric device, wherein the second electrode is on a second surface opposite to a first surface of the second piezoelectric device facing the first piezoelectric device.

3. The vibration generating device of claim 2, wherein the first piezoelectric device comprises:

a peripheral portion with the at least one slit therein; and a center portion surrounded by the peripheral portion.

4. The vibration generating device of claim 3, wherein the peripheral portion of the first piezoelectric device comprises a plurality of protrusions extending in a direction parallel to the first electrode with the at least one slit therebetween.

5. The vibration generating device of claim 4, wherein each of the plurality of protrusions and the accommodation part overlaps in a thickness direction of the first piezoelectric device.

6. The vibration generating device of claim 1, wherein the at least one slit of the first piezoelectric device is spaced apart from the first electrode and extends in a direction parallel to the first electrode.

7. The vibration generating device of claim 2, wherein:

the second piezoelectric device further comprises:

a supporting part between the first piezoelectric device and the second electrode; and a sidewall between the supporting part and the first electrode and surrounding the first piezoelectric device, and the accommodation part extends from an inner surface of the sidewall and fills the at least one slit.

8. The vibration generating device of claim 2, wherein the second piezoelectric device acts as a mold for forming the first piezoelectric device.

9. The vibration generating device of claim 1, wherein the at least one slit has a cross-sectional shape that is triangular or tetragonal in a thickness direction of the first piezoelectric device.

10. The vibration generating device of claim 1, wherein the at least one slit has a cross-sectional shape that is tetragonal in a thickness direction of the first piezoelectric device.

11. The vibration generating device of claim 1, wherein the first piezoelectric device comprises piezopolymer including at least one of poly vinylidene fluoride (PVDF) homopolymer, PVDF copolymer, PVDF terpolymer, cyano-polymer, cyano-copolymer, boron (BN) polymer, and boron nitride polymer.

12. The vibration generating device of claim 2, wherein the second piezoelectric device comprises a synthetic polymer including at least one of cellulose, polypropylene, and Kevlar.

13. The vibration generating device of claim 2, wherein the first piezoelectric device comprises a material which is higher in piezoelectric properties than the second piezoelectric device.

14. An electronic apparatus, comprising:

a display module configured to display an image; and a vibration generating panel including at least one vibration generating device on one surface of the display module, wherein the vibration generating device comprises:

a first piezoelectric device including at least one slit;

a first electrode on a first surface of the first piezoelectric device;

a second piezoelectric device including an accommodation part accommodated into the at least one slit and covering a second surface opposite to the first surface of the first piezoelectric device; and a second electrode on a second surface opposite to a first surface of the second piezoelectric device facing the first piezoelectric device, wherein the at least one slit of the first piezoelectric device is disposed between the first electrode and the second electrode, and is configured to be concave from a lateral side surface of the first piezoelectric device.

15. The electronic apparatus of claim 14, wherein the vibration generating panel comprises:

a first vibration generating device overlapping a first region of the display module; and a second vibration generating device overlapping each of a plurality of second regions spaced apart from the first region.

16. The electronic apparatus of claim 15, wherein:

each of the first and second vibration generating devices comprises the first piezoelectric device, the first electrode, the second piezoelectric device, and second electrode, and the first vibration generating device comprises more slits than number of slits of the second vibration generating device.

17. The electronic apparatus of claim 15, wherein the vibration generating panel further comprises a third vibration generating device overlapping a third region surrounding the first region and the plurality of second regions.

18. The electronic apparatus of claim 17, wherein the third vibration generating device comprises:

a third piezoelectric device including the same material as a material of the first piezoelectric device;

a first electrode on a first surface of the third piezoelectric device; and a second electrode on a second surface opposite to the first surface of the third piezoelectric device.

19. The electronic apparatus of claim 16, wherein:

each of the first and second vibration generating devices comprises a plurality of protrusion portions extending in a direction parallel to the first electrode with the at least one slit therebetween; and the first vibration generating device comprises more protrusion portions than number of protrusion portions of the second vibration generating device.

20. The electronic apparatus of claim 16, wherein the first vibration generating device comprises more accommodation parts than number of accommodation parts of the second vibration generating device.

21. The electronic apparatus of claim 18, wherein the second electrodes of the first to third vibration generating devices share an electrode provided as one body.

22. The electronic apparatus of claim 17, further comprising a sound absorbing member between the first region and the third region and between the second region and the third region.

23. The electronic apparatus of claim 17, further comprising an air gap between the first region and the third region and between the second region and the third region.

24. The electronic apparatus of claim 17, wherein the first region is one peripheral region of the display module, the plurality of second regions are in center region of the display module, and the third region is a region except the first region and the second regions of the display module.

* * * * *